US011912469B2

(12) United States Patent
Roth et al.

(10) Patent No.: US 11,912,469 B2
(45) Date of Patent: Feb. 27, 2024

(54) CAPS AND CONTAINERS CONTAINING THE SAME

(71) Applicant: Cool Gear International, LLC, Plymouth, MA (US)

(72) Inventors: Donna Roth, Duxbury, MA (US); Troy Kyle, Pembroke, MA (US)

(73) Assignee: Cool Gear International, LLC, Plymouth, MA (US)

( * ) Notice: Subject to any disclaimer, the term of this patent is extended or adjusted under 35 U.S.C. 154(b) by 0 days.

(21) Appl. No.: 14/768,950

(22) PCT Filed: Feb. 18, 2014

(86) PCT No.: PCT/US2014/016812
§ 371 (c)(1),
(2) Date: Aug. 19, 2015

(87) PCT Pub. No.: WO2014/137582
PCT Pub. Date: Sep. 12, 2014

(65) Prior Publication Data

US 2016/0001933 A1 Jan. 7, 2016

Related U.S. Application Data

(60) Provisional application No. 61/766,389, filed on Feb. 19, 2013.

(51) Int. Cl.
*B65D 43/20* (2006.01)
*B65D 81/38* (2006.01)
(Continued)

(52) U.S. Cl.
CPC ..... *B65D 43/20* (2013.01); *B65D 1/40* (2013.01); *B65D 43/22* (2013.01); *B65D 47/286* (2013.01); *B65D 81/3841* (2013.01)

(58) Field of Classification Search
CPC ..... B65D 47/26; B65D 47/265; B65D 43/20; B65D 1/40; B65D 43/22; A47G 19/2272
(Continued)

(56) References Cited

U.S. PATENT DOCUMENTS 2,091,686 A * 8/1937 Neuhausen ..... B65D 47/26 222/512
2,475,896 A * 7/1949 Husted ..... A24F 15/12 206/259
(Continued)

FOREIGN PATENT DOCUMENTS

AU 2004100578 9/2004
AU 2004201562 10/2005
(Continued)

OTHER PUBLICATIONS

Extended European Search Report for European Application No. 14 759 974.0 (dated Feb. 26, 2016).
(Continued)

*Primary Examiner* — Anthony D Stashick
*Assistant Examiner* — Blaine G Neway
(74) *Attorney, Agent, or Firm* — Dinsmore & Shohl LLP

(57) ABSTRACT

One aspect of the invention provides a cap comprising: a plane defining an opening and a slidable closure adapted and configured to seal the opening. The slidable closure includes: a projection extending above an external surface of the plane and a flexible seal coupled to the projection and located on an internal surface of the plane opposite the projection. The flexible seal includes: a connection portion coupled to the projection; a sealing portion having a profile that is complementary to a shape of the opening; and a flexible hinge adapted and configured to bias the sealing portion against the internal surface. Another aspect of the invention provides a container assembly including: a con-
(Continued)

tainer and the cap as described herein coupled to the container.

10 Claims, 8 Drawing Sheets

(51) Int. Cl.
*B65D 47/28* (2006.01)
*B65D 1/40* (2006.01)
*B65D 43/22* (2006.01)

(58) Field of Classification Search
USPC ..... 220/254.5, 254.1, 715
See application file for complete search history.

(56) References Cited

U.S. PATENT DOCUMENTS

| | | | | |
|---|---|---|---|---|
| 2,480,733 | A * | 8/1949 | Hermani | B65D 47/28 220/254.9 |
| 2,817,451 | A * | 12/1957 | Giles | B65D 47/265 116/308 |
| 3,964,631 | A * | 6/1976 | Albert | B65D 47/249 220/254.3 |
| 4,099,642 | A * | 7/1978 | Nergard | A47G 19/2272 220/254.5 |
| 4,138,033 | A * | 2/1979 | Payne | B65D 47/2018 220/254.3 |
| 4,213,310 | A | 7/1980 | Buss | |
| 4,253,587 | A | 3/1981 | Otterson | |
| D262,856 | S | 2/1982 | Mactavish | |
| D268,469 | S | 4/1983 | Ruxton et al. | |
| 4,441,637 | A | 4/1984 | Libit | |
| D279,346 | S | 6/1985 | Ruxton | |
| D294,325 | S | 2/1988 | Fiore, Jr. | |
| D338,130 | S | 8/1993 | Costello | |
| 5,706,972 | A * | 1/1998 | Sousa | A47G 19/2272 220/254.5 |
| 5,875,915 | A * | 3/1999 | Bradshaw | B65D 43/0218 206/508 |
| 5,964,365 | A | 10/1999 | Peeples | |
| 6,164,484 | A | 12/2000 | Fiore | |
| 6,494,056 | B1 | 12/2002 | Roth | |
| 6,584,800 | B1 | 7/2003 | Roth | |
| D478,469 | S | 8/2003 | Roth | |
| 6,601,403 | B1 | 8/2003 | Roth | |
| D485,468 | S | 1/2004 | Roth | |
| 6,824,003 | B1 * | 11/2004 | Wong | B65D 43/0202 220/254.9 |
| D511,435 | S | 11/2005 | Roth | |
| D512,875 | S | 12/2005 | Maldonado | |
| D518,335 | S | 4/2006 | Stuart | |
| 7,082,784 | B2 | 8/2006 | Roth | |
| D549,048 | S | 8/2007 | Duke | |
| 7,513,380 | B2 * | 4/2009 | Canedo | A45F 3/18 220/230 |
| D624,361 | S | 9/2010 | Roth | |
| 7,866,183 | B2 | 1/2011 | Roth | |
| D634,158 | S | 3/2011 | Roth | |
| D634,161 | S | 3/2011 | Roth | |
| 7,997,099 | B2 | 8/2011 | Roth | |
| 8,051,674 | B2 | 11/2011 | Roth | |
| 8,061,158 | B2 | 11/2011 | Roth | |
| 8,276,776 | B2 | 10/2012 | Roth | |
| 8,408,414 | B2 | 4/2013 | Roth | |
| 8,544,676 | B2 | 10/2013 | Roth | |
| D696,906 | S | 1/2014 | Roth | |
| 8,777,039 | B2 | 7/2014 | Roth | |
| RE45,055 | E | 8/2014 | Roth | |
| D738,163 | S | 9/2015 | Roth | |
| 9,380,898 | B2 | 7/2016 | Mason | |
| D804,903 | S | 12/2017 | Mason | |
| D804,904 | S | 12/2017 | Noveletsky | |
| 9,944,438 | B2 | 4/2018 | Roth | |
| 10,077,143 | B2 | 9/2018 | Roth | |
| 10,196,182 | B2 | 2/2019 | Roth | |
| D874,217 | S | 2/2020 | Tsai | |
| 2003/0196448 | A1 | 10/2003 | Roth | |
| 2005/0051552 | A1 * | 3/2005 | Kim | A47G 19/2272 220/254.1 |
| 2006/0185384 | A1 | 8/2006 | Roth | |
| 2007/0095845 | A1 | 5/2007 | Auer | |
| 2007/0164027 | A1 | 7/2007 | Auer | |
| 2008/0078200 | A1 | 4/2008 | Roth | |
| 2008/0217284 | A1 | 9/2008 | Roth | |
| 2009/0001090 | A1 * | 1/2009 | Karam | B65D 1/265 220/669 |
| 2009/0173737 | A1 | 7/2009 | Ramsey et al. | |
| 2010/0126992 | A1 | 5/2010 | Phillips | |
| 2010/0193462 | A1 | 8/2010 | Roth | |
| 2012/0234789 | A1 | 9/2012 | Mason | |
| 2012/0285961 | A1 | 11/2012 | Roth | |
| 2013/0214006 | A1 | 8/2013 | Roth | |
| 2016/0001933 | A1 | 1/2016 | Roth | |
| 2017/0015462 | A1 | 1/2017 | Roth | |
| 2017/0050775 | A1 | 2/2017 | Sanbar | |
| 2017/0050785 | A1 | 2/2017 | Roth | |
| 2019/0135502 | A1 | 5/2019 | Tsai | |
| 2020/0055646 | A1 | 2/2020 | DeKeyser | |
| 2020/0148431 | A1 | 5/2020 | Tsai | |
| 2020/0216218 | A1 | 7/2020 | Sanbar | |
| 2020/0216232 | A1 | 7/2020 | Noveletsky | |
| 2020/0367678 | A1 | 11/2020 | Harris | |

FOREIGN PATENT DOCUMENTS

| | | |
|---|---|---|
| AU | 328776 | 12/2009 |
| AU | 2010200265 | 8/2010 |
| AU | 2011332161 | 5/2013 |
| AU | 2016201471 | 4/2016 |
| AU | 2014368954 | 6/2016 |
| AU | 2015218686 | 9/2016 |
| AU | 1491016 | 11/2016 |
| AU | 1491116 | 11/2016 |
| AU | 1644816 | 11/2016 |
| AU | 1644916 | 11/2016 |
| AU | 2015259105 | 11/2016 |
| AU | 2015259182 | 11/2016 |
| AU | 2015259183 | 11/2016 |
| AU | 2017204758 | 7/2017 |
| AU | 2017226173 | 9/2018 |
| AU | 2017226178 | 9/2018 |
| AU | 2017354038 | 5/2019 |
| AU | 2018309062 | 2/2020 |
| AU | 2019376154 | 3/2021 |
| CA | 51305 | 5/1983 |
| CA | 2292400 | 6/2000 |
| CA | 2470906 | 6/2005 |
| CA | 132268 | 6/2010 |
| CA | 135424 | 6/2010 |
| CA | 135425 | 6/2010 |
| CA | 2691193 | 8/2010 |
| CA | 2817042 | 5/2012 |
| CA | 2900674 | 9/2014 |
| CA | 2933614 | 6/2015 |
| CA | 2939634 | 8/2015 |
| CA | 2948174 | 11/2015 |
| CA | 2948176 | 11/2015 |
| CA | 2948180 | 11/2015 |
| CA | 3016564 | 9/2017 |
| CA | 3042043 | 5/2018 |
| CA | 170355 | 9/2018 |
| CA | 170356 | 9/2018 |
| CA | 178839 | 9/2018 |
| CA | 178861 | 9/2018 |
| CA | 172791 | 1/2019 |
| CA | 3070466 | 2/2019 |
| CA | 3112845 | 5/2020 |
| CN | 101798009 | 8/2010 |
| CN | 201770189 | 3/2011 |
| CN | 106170444 | 11/2016 |
| CN | 106414265 | 2/2017 |
| CN | 106458385 | 2/2017 |

(56) References Cited

FOREIGN PATENT DOCUMENTS

| | | | |
|---|---|---|---|
| CN | 106660672 | | 5/2017 |
| CN | 109068879 | | 12/2018 |
| CN | 109071073 | | 12/2018 |
| CN | 109744820 | | 5/2019 |
| CN | 110997512 | | 4/2020 |
| CN | 112996411 | | 6/2021 |
| DK | 2958818 | | 10/2017 |
| EP | 1 247 752 | A1 | 10/2002 |
| EP | 2958818 | | 12/2015 |
| EP | 3107814 | | 12/2016 |
| EP | 3142941 | | 3/2017 |
| EP | 2958818 | B1 | 7/2017 |
| EP | 3142939 | | 11/2017 |
| EP | 3142940 | | 12/2017 |
| EP | 3257778 | | 12/2017 |
| EP | 3083443 | | 6/2018 |
| EP | 3534757 | | 9/2019 |
| EP | 3423372 | | 3/2020 |
| EP | 3661853 | | 6/2020 |
| EP | 3876785 | | 9/2021 |
| ES | 2642832 | | 11/2017 |
| FR | 2780385 | A1 | 12/1999 |
| GB | 2442593 | | 2/2009 |
| GB | 2467629 | | 8/2010 |
| GB | 2477219 | | 7/2011 |
| GB | 2475189 | | 9/2011 |
| GB | 2482766 | | 2/2012 |
| GB | 2528619 | | 1/2016 |
| HK | 1157301 | | 11/2012 |
| HK | 1167376 | | 3/2013 |
| HR | P20171530 | | 2/2018 |
| JP | 2003312706 | | 11/2003 |
| JP | 2008120456 | | 5/2008 |
| JP | 2014500835 | | 1/2014 |
| JP | 2017504532 | | 2/2017 |
| JP | 2017509555 | | 4/2017 |
| JP | 2017518928 | | 7/2017 |
| JP | 2017518929 | | 7/2017 |
| JP | 2017520483 | | 7/2017 |
| JP | 2019506983 | | 3/2019 |
| JP | 2019507710 | | 3/2019 |
| KR | 1020030064663 | | 8/2003 |
| KR | 1020160102033 | | 8/2016 |
| KR | 1020170007389 | | 1/2017 |
| KR | 1020170007393 | | 1/2017 |
| KR | 1020170009900 | | 1/2017 |
| KR | 1020180107285 | | 10/2018 |
| KR | 1020180116426 | | 10/2018 |
| KR | 1020200027572 | | 3/2020 |
| KR | 1020210089660 | | 7/2021 |
| MX | PA03001327 | | 7/2005 |
| MX | 2016008030 | | 10/2016 |
| MX | 2016014799 | | 3/2017 |
| MX | 2016014803 | | 3/2017 |
| MX | 2016014804 | | 3/2017 |
| MX | 2018010638 | | 5/2019 |
| MX | 2018010641 | | 6/2019 |
| PL | 2958818 | | 3/2018 |
| SI | 2958818 | | 12/2017 |
| WO | 2006/009450 | A1 | 1/2006 |
| WO | WO2008112504 | | 9/2008 |
| WO | 2009/103817 | A1 | 8/2009 |
| WO | 2011/026991 | A1 | 3/2011 |
| WO | WO2012071218 | | 5/2012 |
| WO | WO2014137582 | | 9/2014 |
| WO | WO2015095776 | | 6/2015 |
| WO | WO2015127373 | | 8/2015 |
| WO | WO2015175689 | | 11/2015 |
| WO | WO2015175716 | | 11/2015 |
| WO | WO2015175717 | | 11/2015 |
| WO | WO2015175723 | | 11/2015 |
| WO | WO2017152016 | | 9/2017 |
| WO | WO2017152021 | | 9/2017 |
| WO | WO2018085412 | | 5/2018 |
| WO | WO2019028326 | | 2/2019 |
| WO | WO2020097501 | | 5/2020 |
| WO | WO2020142252 | | 7/2020 |

OTHER PUBLICATIONS

U.S. Appl. No. 62/787,894, filed Dec. 20, 2019 titled Container Lid With Rotatable Sipper and Flexible Handle.

Australian Patent Application No. 2014226443 titled "Caps and containers containing the same" Filed on Feb. 18, 2014.

Examination Report No. 1 for Australian Patent Application No. 2014226443 dated Feb. 15, 2017.

Examination Report No. 2 for Australian Patent Application No. 2014226443 dated Oct. 23, 2017.

Examination Report No. 3 for Australian Patent Application No. 2014226443 dated Feb. 6, 2018.

Canada Patent Application No. 2900674 titled "Caps and containers containing the same" Filed on Aug. 7, 2015.

Examiner RequisitionCanada Patent Application No. 2900674 mailed on Jan. 27, 2020.

Examiner RequisitionCanada Patent Application No. 2900674 mailed on Sep. 8, 2020.

Extended European Search Report for European Patent Application No. 17180673.0 dated Nov. 15, 2017.

Office Action for European Patent Application No. 17180673.0 dated Aug. 9, 2019.

Intention to Grant for European Patent Application No. 17180673.0 dated Oct. 8, 2020.

Decision to Grant for European Patent Application No. 17180673.0 dated Feb. 25, 2021.

European Patent Application No. 14759974.0 titled "Caps and containers containing the same" Filed on Feb. 18, 2014.

Intention to Grant for European Patent Application No. 14759974.0 dated Feb. 16, 2017.

Decision to Grant for European Patent Application No. 14759974.0 dated Jun. 16, 2017.

PCT Patent Application No. PCT/US2014/016812 titled "Caps and containers containing the same" Filed on Feb. 18, 2014.

International Search Report and Written Opinion for PCT Patent Application No. PCT/US2014/016812 dated Jun. 2, 2014.

International Preliminary Report on Patentability for PCT Patent Application No. PCT/US2014/016812 dated Sep. 3, 2015.

U.S. Appl. No. 61/766,389 titled "Caps and containers containing the same" Filed on Feb. 19, 2013.

* cited by examiner

CAPS AND CONTAINERS CONTAINING THE SAME

RELATED APPLICATION

The present invention claims priority to U.S. Provisional Application Ser. No. 61/766,389, filed Feb. 19, 2013, the contents of which are incorporated herein by reference.

BACKGROUND

As consumers continue to become more environmentally-conscious, there is a continued need for reusable containers.

SUMMARY OF THE INVENTION

One aspect of the invention provides a cap comprising: a plane defining an opening and a slidable closure adapted and configured to seal the opening. The slidable closure includes: a projection extending above an external surface of the plane and a flexible seal coupled to the projection and located on an internal surface of the plane opposite the projection. The flexible seal includes: a connection portion coupled to the projection; a sealing portion having a profile that is complementary to a shape of the opening; and a flexible hinge adapted and configured to bias the sealing portion against the internal surface.

This aspect of the invention can have a variety of embodiments. The flexible seal can be fabricated from silicone.

The flexible hinge can be an arc, an underside of which faces the internal surface. The arc can have a radius of about 180°.

The opening can have a profile selected from the group consisting of: a circle, an oval, and an ellipse.

The plane can define a linear slot adapted and configured to receive the slidable closure and permit sliding in a single dimension.

The sealing portion can include one or more support ribs.

The sealing portion can include a peripheral ring having a stiffness that is less than a remainder of the sealing portion.

Another aspect of the invention provides a container assembly including: a container and the cap as described herein coupled to the container.

This aspect of the invention can have a variety of embodiments. The container can be a single-walled container. The container can be a double-walled container.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views and wherein.

DEFINITIONS

The instant invention is most clearly understood with reference to the following definitions:

As used herein, the singular form "a", "an" and "the" include plural references unless the context clearly dictates otherwise.

DETAILED DESCRIPTION OF THE INVENTION

Figure 1A:
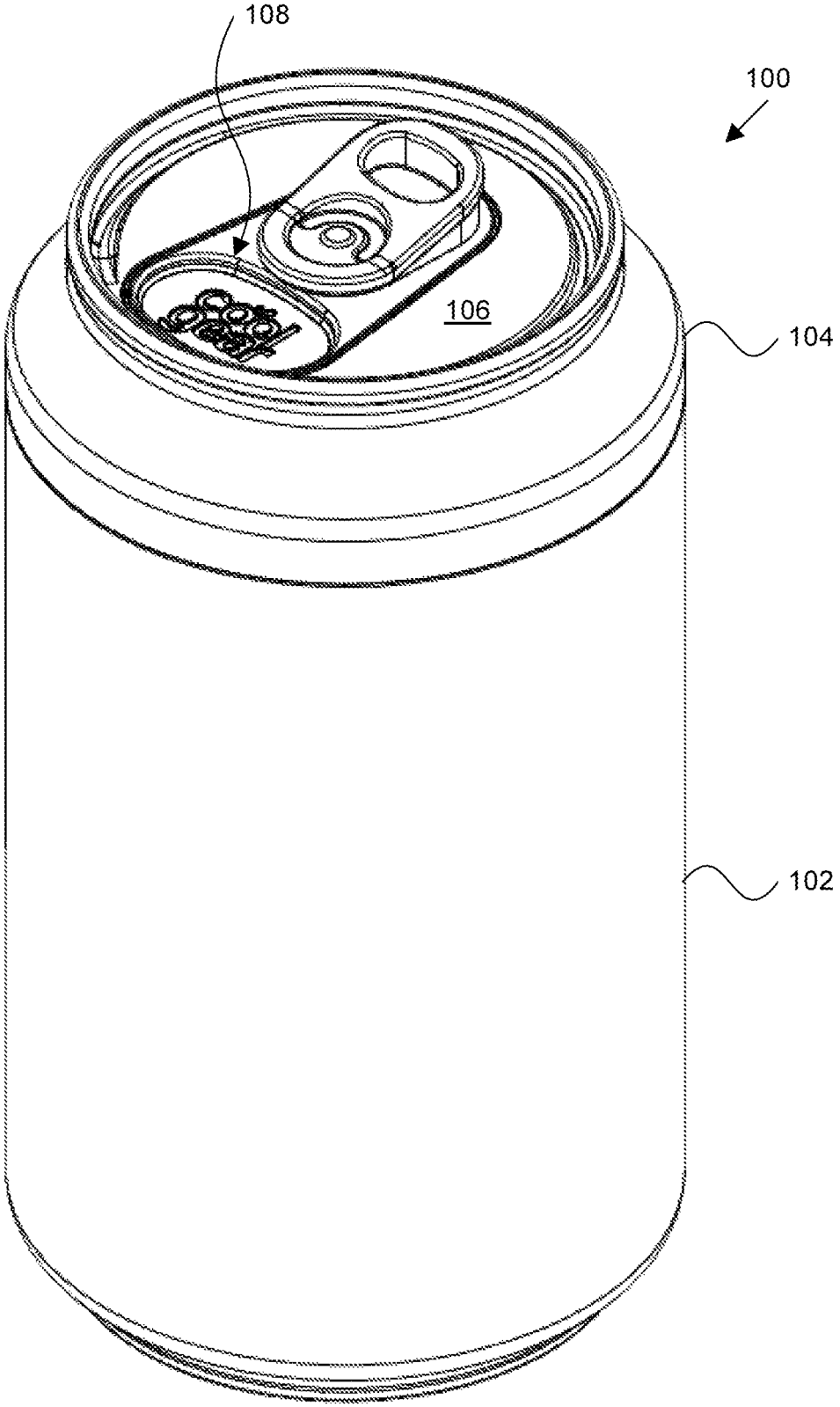
FIG. 1A provides a perspective view of a container assembly according to an embodiment of the invention.
Figure 1B:
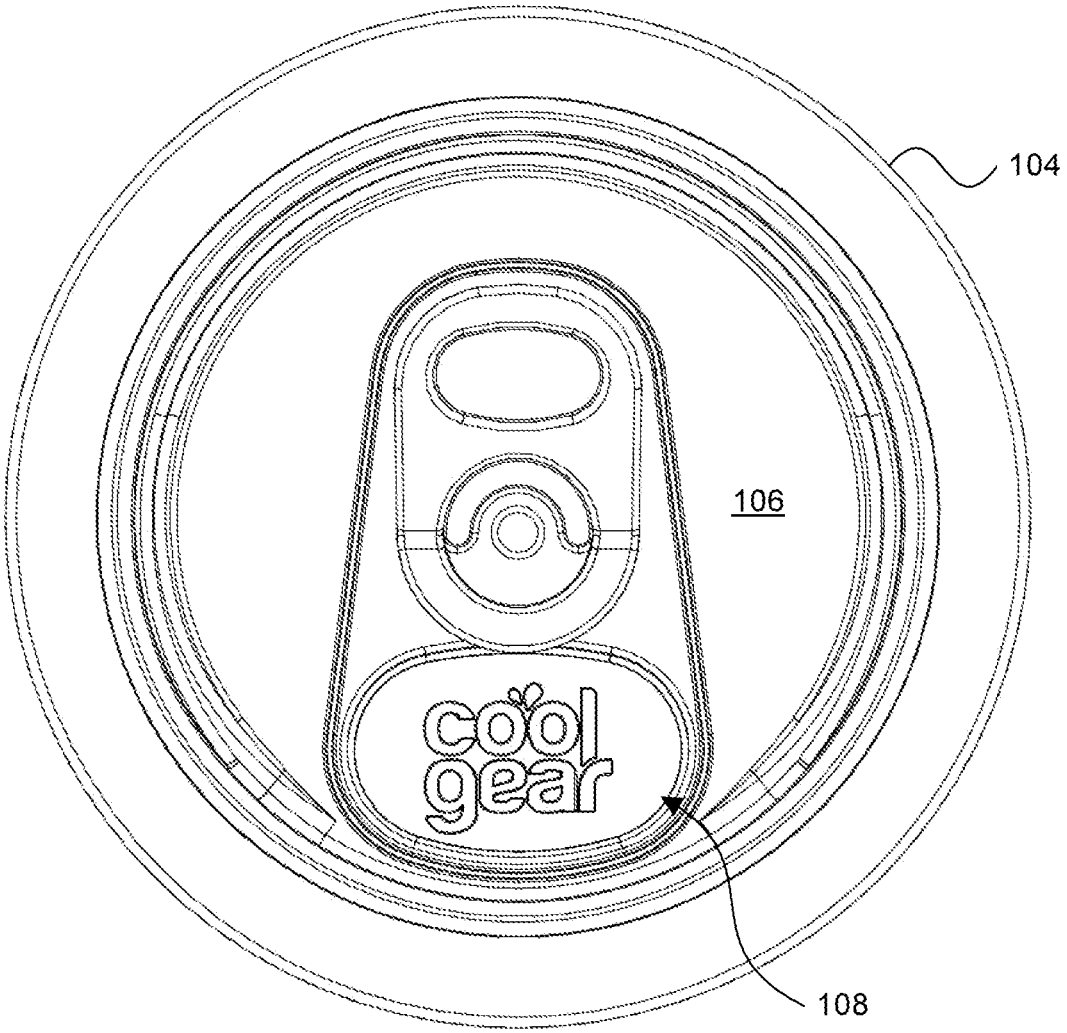
FIG. 1B provides a top view of a cap according to another embodiment of the invention.
Figure 1C:
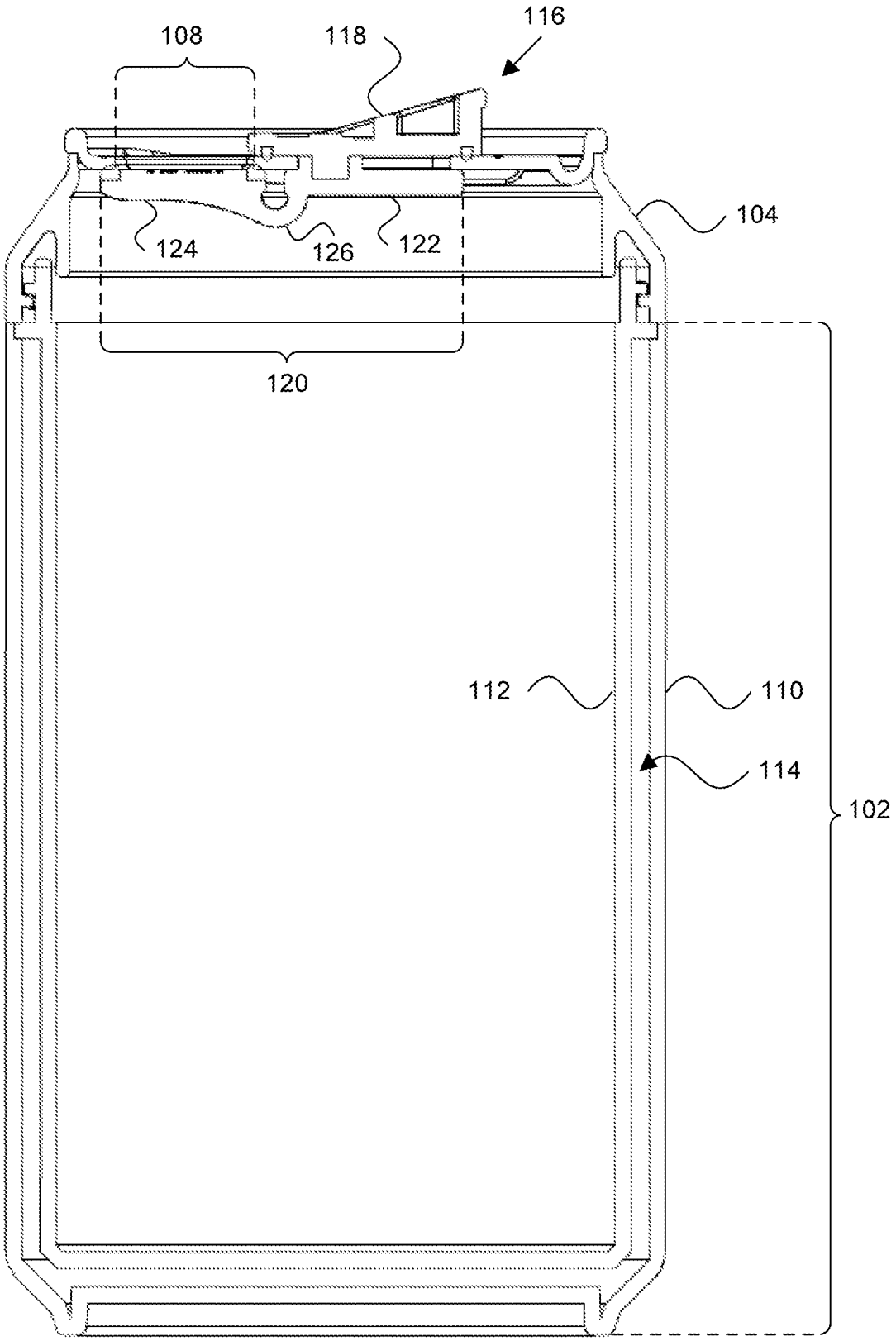
FIG. 1C provides a cross-sectional view of a container assembly according to another embodiment of the invention.

Referring now to FIGS. 1A-1C, a container assembly 100 includes a container 102 and a cap 104 coupled to the container 102 (e.g., by a threaded, twist-lock, or snap-fit connection). Cap 104 includes a plane 106 defining an opening 108.

Referring now to FIG. 1C, a cross-section of container assembly 100 is provided. As seen in the cross-sectional view, container 102 can, in some embodiments, be a double-walled container having an outer wall 110 and an inner wall 112 defining a volume 114 therebetween. This volume 114 can facilitate formation of a vacuum or other low-pressure region in order to reduce thermal conductivity across the container 102. Additional or alternatively, insulative materials can be introduced into volume 114. For example, foams and/or films such as metallic foams or biaxially-oriented polyethylene terephthalate (BoPET) films can be utilized. In some embodiments, the container assembly 100 may be able to maintain a cold beverage at a temperature less than about 40° F. for between about 9 hours and about 12 hours.

FIG. 1C also depicts the structure and operation of slidable closure 116 that includes a projection 118 extending above an external surface of the plane 106 and a flexible seal 120 coupled to the projection 118 and located on an internal surface of the plane 106 opposite the projection 118.

Figure 1D:
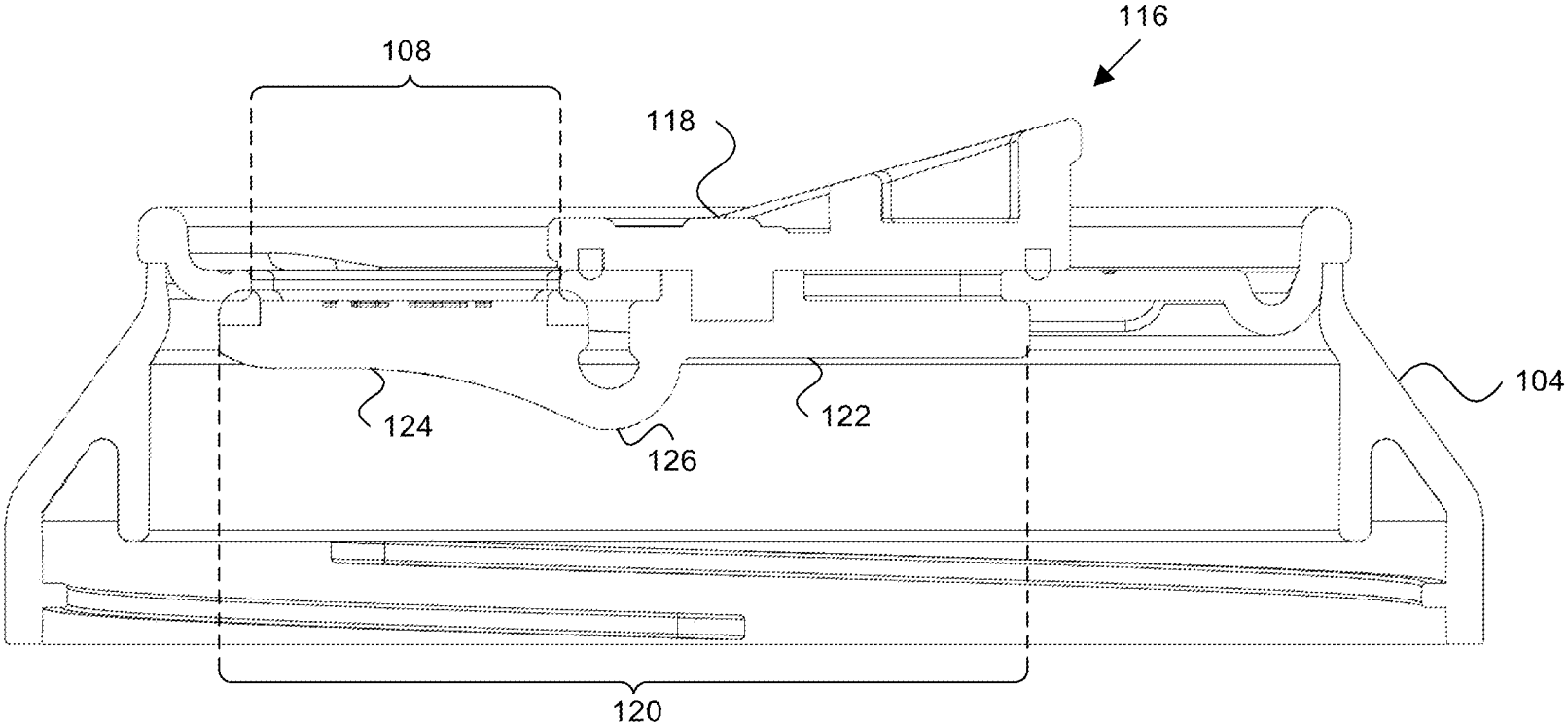
FIG. 1D provides a cross-sectional view of a cap in a closed position according to another embodiment of the invention.

Referring now to FIG. 1D, the structure and operation of slidable closure 116 can be visualized in greater detail in a cross section of the cap 104. The flexible seal 120 includes a connection portion 122 coupled to the projection 118 (e.g., by an interference fitting, press fitting, adhesive, welding, and the like), a sealing portion 124 having a profile that is complementary to a shape of the opening 108, and a flexible hinge 126 adapted and configured to bias the sealing portion 124 against the internal surface.

In some embodiments, the flexible seal 120 is a single piece formed from a flexible and preferably food-safe material such as silicone. In other embodiments, multiple materials can be utilized to selectively promote stiffness in some regions and flexibility in other regions. For example, as more clearly seen in the cross-section of slidable closure 116 depicted in FIG. 1E, a peripheral ring 127 can be formed from a more flexible material than the remainder of the sealing portion 124 so that peripheral ring 127 will form a good seal while being pressed tightly against opening 108.

Figure 1E:
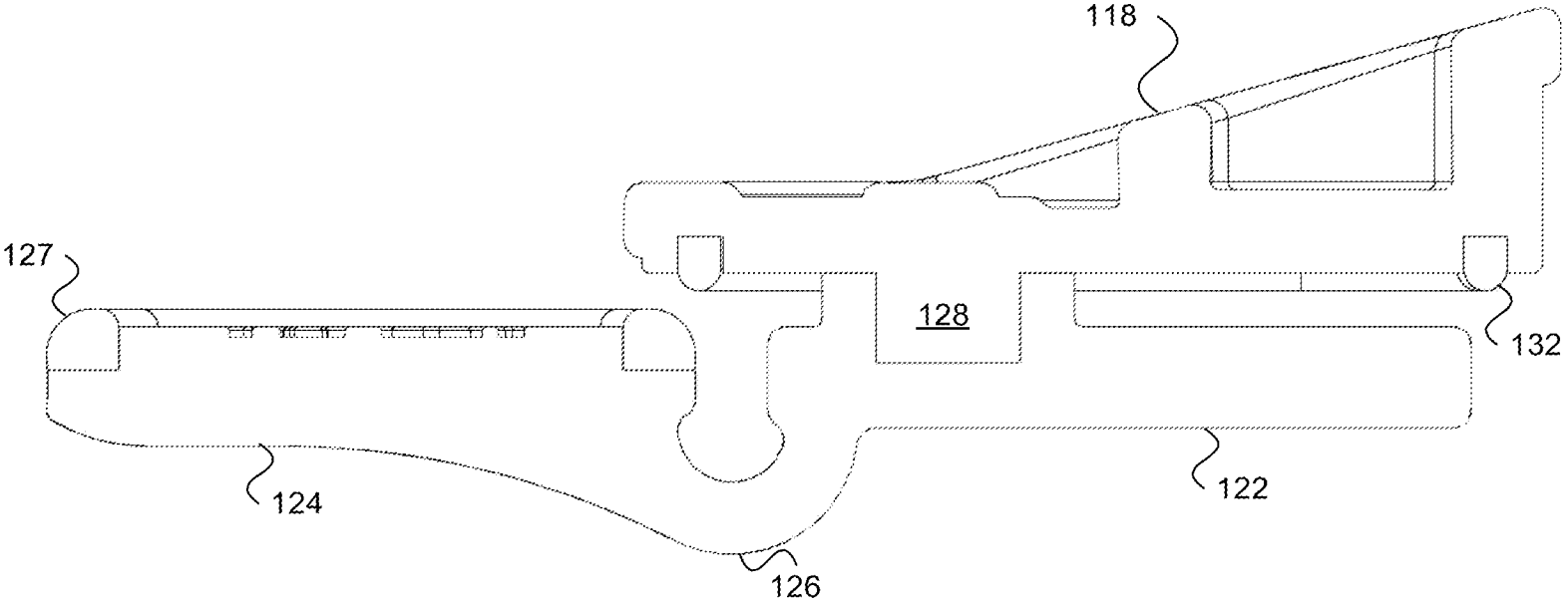
FIG. 1E provides a cross-sectional view of a slidable closure according to another embodiment of the invention.
Figure 1F:
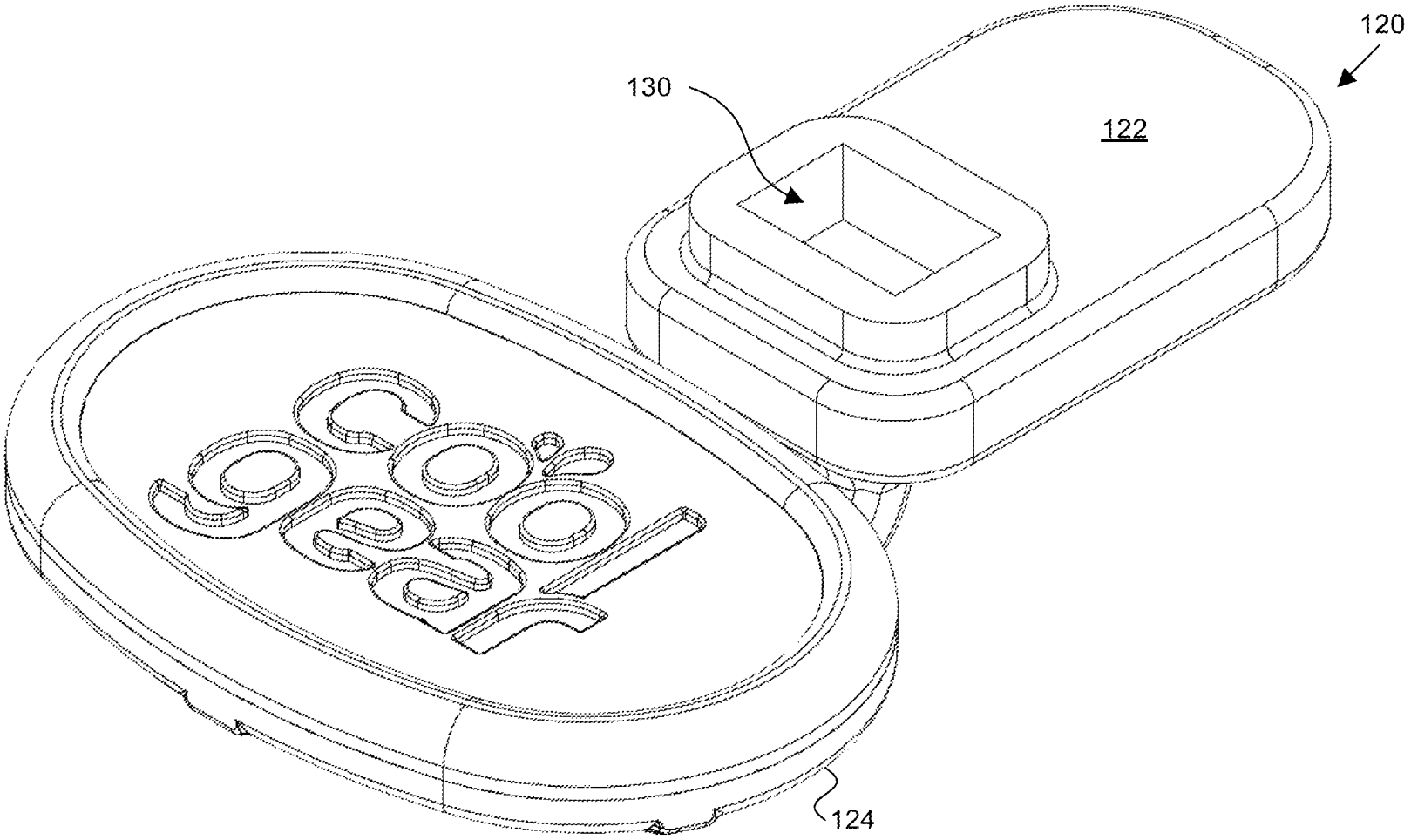
FIG. 1F provides a perspective view of a flexible seal according to another embodiment of the invention.
Figure 1G:
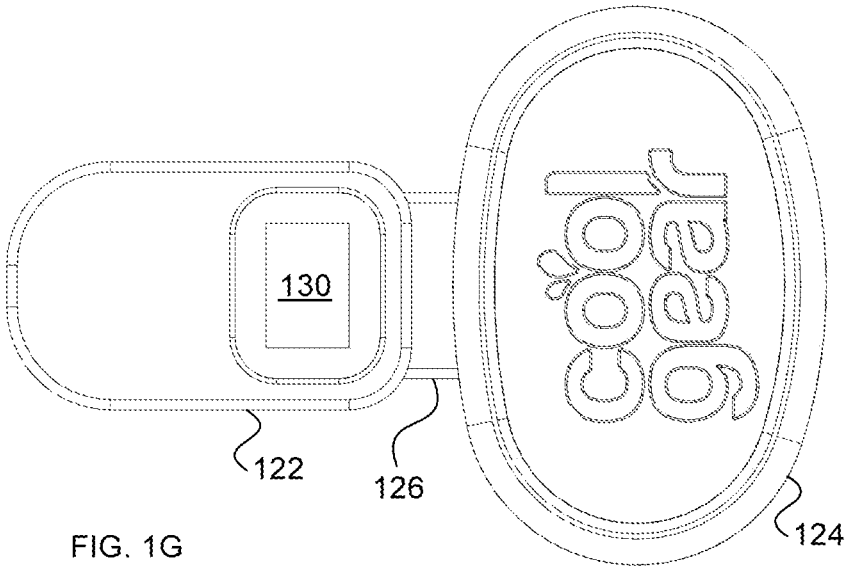
FIG. 1G provides a top view of a flexible seal according to another embodiment of the invention.
Figure 1H:
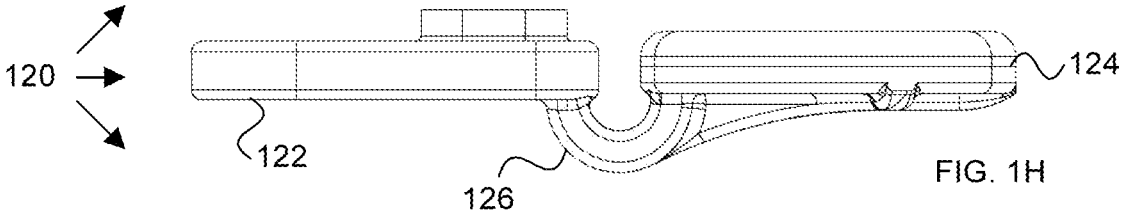
FIG. 1H provides a side view of a flexible seal according to another embodiment of the invention.

Still referring to FIG. 1E and also referring to FIGS. 1F-1H, projection 118 can optionally include a post 128 that facilitates sliding of the projection 118 within a groove in cap 104 as well as coupling with flexible seal 120 (e.g., through a complementary recess 130 in connection portion 122). Projection 118 can also optionally include an O-ring 132 or other elastomeric material that can minimize leaks around slidable closure 116 and/or allow for easier sliding of projection 118. Sealing portion 124 can, in some embodiments, have rounded edges in order to facilitate sealing contact with opening 108.

Figure 1I:
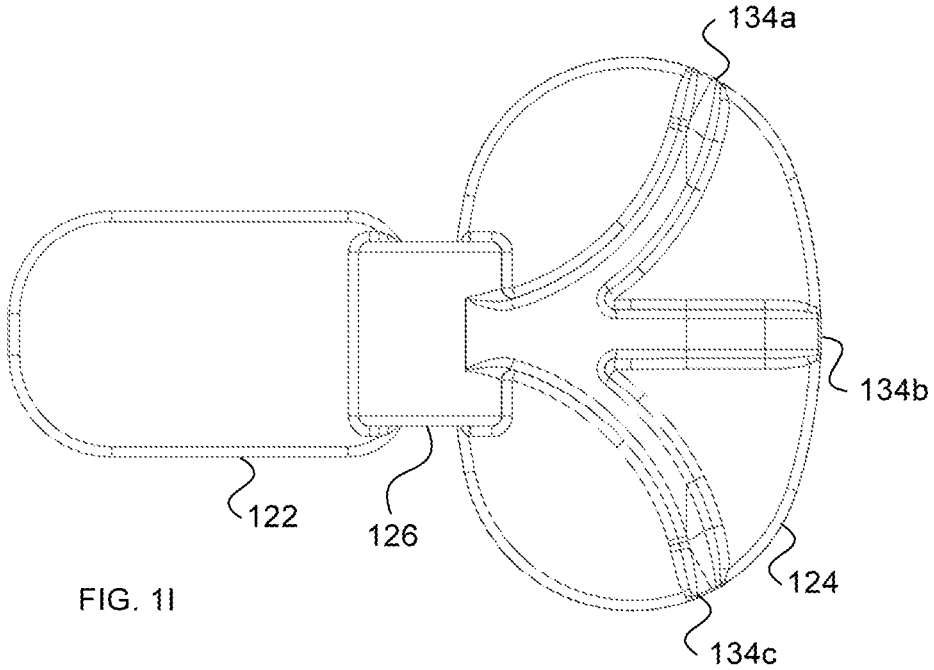
FIG. 1I provides a bottom view of a flexible seal according to another embodiment of the invention.

Referring now to FIG. 1I, flexible seal 120 can include one or more supporting ribs 134*a*-134*c* that are adapted and configured to resist deformation of the sealing portion 124 when pressed against the opening 108. Supporting ribs 134 can be made from the same material as the sealing portion 124 or can be made from a different material (e.g., a stiffer material than the sealing portion 124).

Figure 1J:
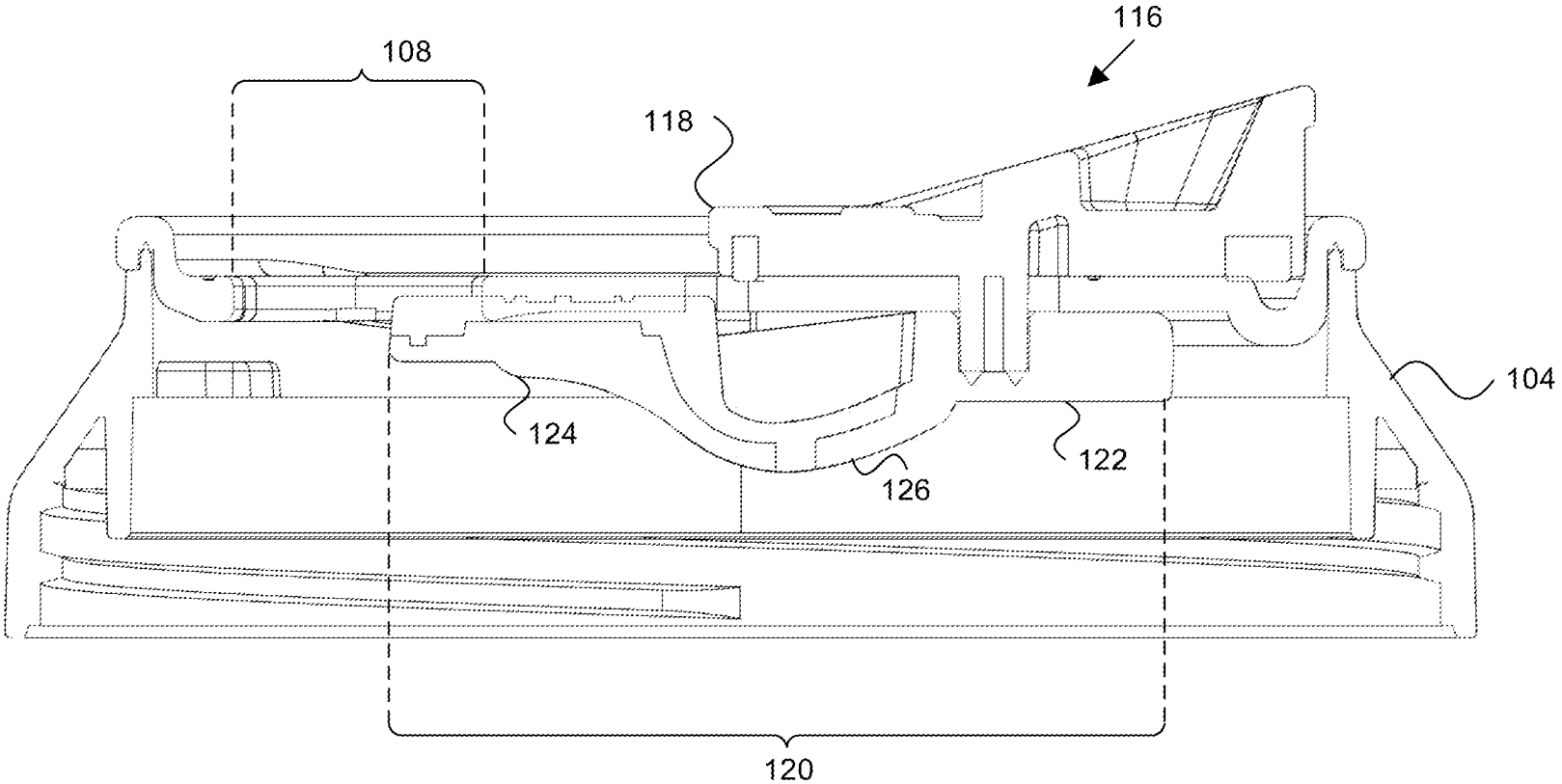
FIG. 1J provides a side view of a cap in an open or drinking position according to another embodiment of the invention.

Referring now to FIG. 1J, another view of cap 104 is provided in which the slidable closure 116 is moved laterally to an open or drinking position.

EQUIVALENTS

Although preferred embodiments of the invention have been described using specific terms, such description is for illustrative purposes only, and it is to be understood that changes and variations may be made without departing from the spirit or scope of the following claims.

INCORPORATION BY REFERENCE

The entire contents of all patents, published patent applications, and other references cited herein are hereby expressly incorporated herein in their entireties by reference.

The invention claimed is:

1. A cap comprising:

a straight, horizontal plane defining an opening; and a slidable closure adapted and configured to seal the opening, the slidable closure comprising:

a projection extending above an external surface of the horizontal plane; and a flexible seal coupled to the projection and located on an internal surface of the horizontal plane opposite the projection, the flexible seal configured to slide between an open position and a closed position of the opening, the flexible seal comprising:

a connection portion coupled to the projection;

a sealing portion having a profile that substantially corresponds to a shape of the opening, the sealing portion comprising:

a peripheral ring defining an uppermost portion of the sealing portion; and two or more support ribs disposed along a bottom surface of said sealing portion, wherein said two or more support ribs each join at one end and extend to differing locations of a periphery of said sealing portion at respective second ends; and a flexible hinge directly connected to the sealing portion and the connection portion, said flexible hinge arranged in an arcuate manner between a bottom surface of the connection portion and said bottom surface of the sealing portion without being fixed to a remainder of the cap, the flexible hinge having an arcuate structure that biases the peripheral ring of the sealing portion against the internal surface and around the opening such that the sealing portion is prevented from entering the opening when the slidable closure is in the closed position, the sealing portion being displaced horizontally along the horizontal plane from the opening when the slidable closure is in the open position, said two or more support ribs engaging said flexible hinge at said one end and engaging said bottom surface of said sealing portion; wherein the flexible seal prevents passage of a beverage therethrough when in the closed position and allows passage of the beverage when in the open position.

2. The cap of claim 1, wherein the flexible seal is fabricated from silicone.

3. The cap of claim 1, wherein the flexible hinge is an arc, an underside of which faces the internal surface.

4. The cap of claim 3, wherein the arc has a radius of about 180°.

5. The cap of claim 1, wherein the opening has a profile selected from the group consisting of: a circle, an oval, and an ellipse.

6. The cap of claim 1, wherein the horizontal plane defines a linear slot adapted and configured to receive the slidable closure and permit sliding in a single dimension.

7. The cap of claim 1, wherein the peripheral ring having a stiffness that is less than a remainder of the sealing portion.

8. A container assembly comprising:

a container; and the cap of claim 1 coupled to the container.

9. The container assembly of claim 8, wherein the container is a single-walled container.

10. The container assembly of claim 8, wherein the container is a double-walled container.

* * * * *